US007785241B2

(12) United States Patent
Plavsic

(10) Patent No.: US 7,785,241 B2
(45) Date of Patent: Aug. 31, 2010

(54) DEVICE FOR OBTAINING A SUBSTANTIALLY CONSTANT LINEAR FORCE

(76) Inventor: Vojin Plavsic, Örntorpsvägen 15, 772 40 Grängesberg (SE)

( * ) Notice: Subject to any disclaimer, the term of this patent is extended or adjusted under 35 U.S.C. 154(b) by 493 days.

(21) Appl. No.: 11/665,606

(22) PCT Filed: Oct. 18, 2005

(86) PCT No.: PCT/SE2005/001557

§ 371 (c)(1),
(2), (4) Date: Jul. 18, 2007

(87) PCT Pub. No.: WO2006/043886

PCT Pub. Date: Apr. 27, 2006

(65) Prior Publication Data

US 2008/0207408 A1 Aug. 28, 2008

(30) Foreign Application Priority Data

Oct. 18, 2004 (SE) ..... 0402530

(51) Int. Cl.
*A63B 21/02* (2006.01)

(52) U.S. Cl. ..... 482/121; 482/122; 482/129; 482/125

(58) Field of Classification Search ..... 482/121, 482/130, 137, 133, 104, 108, 105–107
See application file for complete search history.

(56) References Cited

U.S. PATENT DOCUMENTS

| | | | |
|---|---|---|---|
| 4,208,049 | A | 6/1980 | Wilson |
| 5,382,212 | A | 1/1995 | Davenport |
| 5,586,962 | A | 12/1996 | Hallmark |

FOREIGN PATENT DOCUMENTS

| | | |
|---|---|---|
| CA | 1214478 | 11/1986 |
| SE | 503542 | 7/1996 |
| WO | 0230520 | 4/2002 |

*Primary Examiner*—Jerome Donnelly
(74) *Attorney, Agent, or Firm*—Young & Thompson

(57) ABSTRACT

A device for obtaining a predetermined linear force, includes a first elastic force elements and a force output elements in the form of a non-elastic, flexible elongated member, a force transformation elements arranged between the first elastic force element and the force output element, such that a pulling of the force output element creates a tension in the first elastic force element. The force transformation element is arranged and designed such that the pulling force required on the force output element decreases with the distance the force output element is pulled. The device includes a second elastic force element and a second force output element attached thereto wherein the pulling force required on the second force output element increases with the distance the force output element is pulled. The two force output elements are connected to each other such as to summarize the forces.

7 Claims, 4 Drawing Sheets

DEVICE FOR OBTAINING A SUBSTANTIALLY CONSTANT LINEAR FORCE

TECHNICAL FIELD

Figure 1:
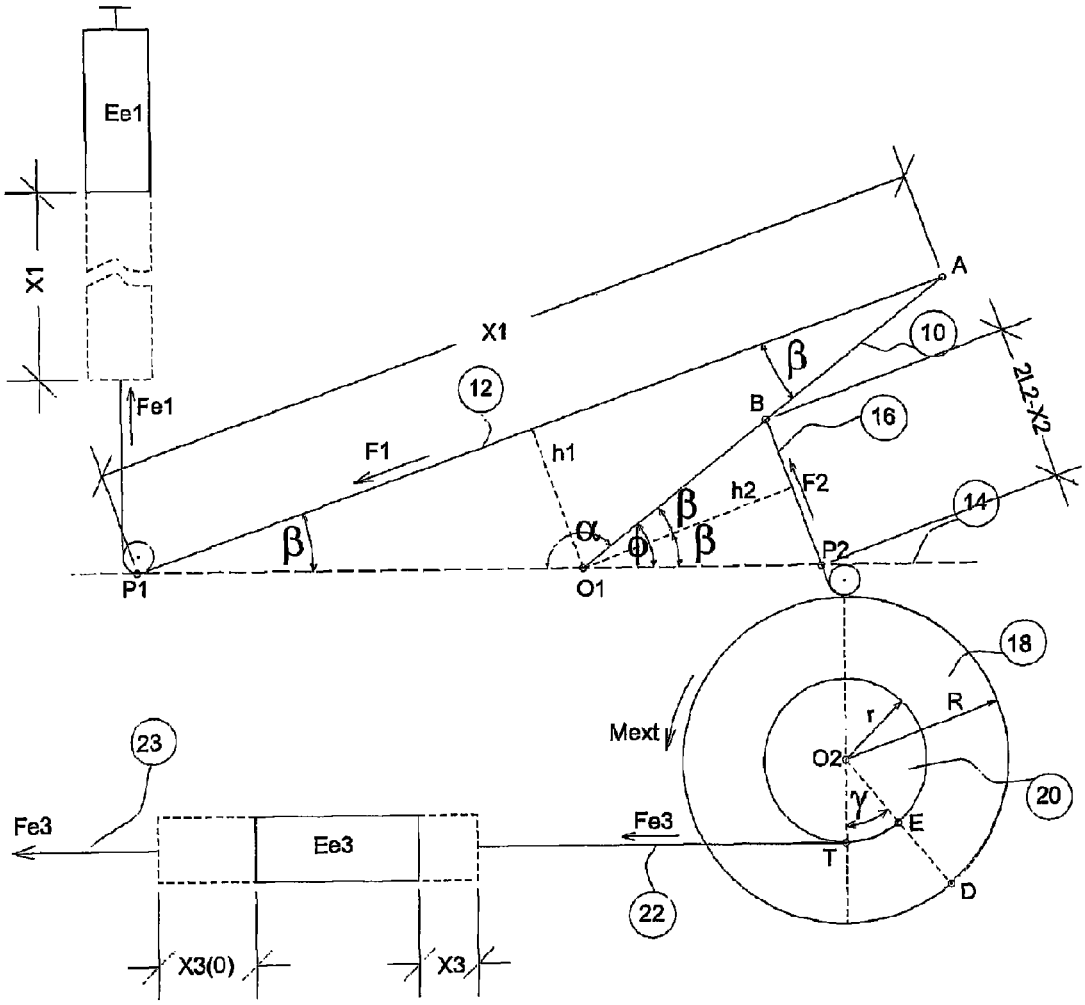

The present invention relates to a device for obtaining predetermined linear forces, in the range from a value near zero to a max value determined by the design, and in particular to a device where the force obtained is substantially constant. These forces are primarily intended for training of the skeleton muscles, but due to its exceptional properties they can be used in various medical, technical and other applications where its features are beneficial.

The present invention is a further development of our previous invention described in WO 02/30520 A1 (referred further as previous invention) in which a pre-settable constant force is obtained by the addition of a down falling or decreasing linear force (referred further as down falling force) with an uprising or increasing linear force (referred further as a up rising force) which has the same linearity quotients.

In the previous invention the resistance to an external force $F_{ext}$, (alternatively torque $M_{ext}$) can be preset to a constant value in an interval from some $F_{min}$ (alternatively torque $M_{min}$) to some $F_{max}$ (alternatively torque $M_{max}$). From the design reasons the Min/Max force-/torque ratio can't be arbitrary low. This practically precludes that the result i.e. addition of the forces, can be preset to a value arbitrarily near zero.

However, in many applications of the previous invention, even very near zero value, are desirable arbitrary variations of the result force values.

The present invention is based on the subtraction of down falling force from the up rising force. It enables to pre-set the resulting force to the constant value arbitrarily from near zero value to a max value defined by the design. The new invention includes practically the same components as the previous one. It is obtained by the rearrangement of the same components, which are figuring in the previous invention. By the subtraction of the forces the max resulting force is obviously lower than the max force obtained by their addition.

By the integration of both inventive concepts, the output force/torque covers the whole range of both inventions i.e. from zero value obtained by the present invention to $F_{max}$ value obtained by the previous invention.

The important issue is that the integrated device can be implemented mainly with the same basic components as of one of both inventions.

Due that the movements in both inventions are illustrated as rotations, then in the proceeding text the concepts will be explained rather in terms of torques than of forces.

Motivation for this Invention

For certain applications the limit of a minimum force value in the first invention, can be a significant drawback.

Most of the training equipments presented on the market today, are intended for a very varying groups of users. For certain groups of users (weak, too young, older or ill persons etc) even the lowest force limit $F_{min}$ can be too high, implying that they can be excluded from the training with devices designed according the first invention.

From the commercial and even ideal reasons the aim of all producers of training equipments is to enrich users as much as possible. Even for the users of the constant force for other purposes than the physical training, it can be advantageous to arbitrarily preset the load, in the wider range from zero to some max value.

DESCRIPTION OF THE INVENTION

The principle according to the present invention will be described in conjunction with the device shown in our FIG. 1, which is a slight modification of FIG. 1 illustrated in the description of the first invention (described in WO 02/30520 A1).

The differences between those two drawings are:

1. the uprising force $Fe_3$ and the down falling force $F_2$ are assembled into the device in a manner to act counter to each other.

2. in the initial position the arm angle $\alpha=\pi$ radians

3. The external force acts in the same direction as down falling force.

The principle according to the present invention will be described in conjunction with the device shown in our FIG. 1. It comprises an arm 10 with a length $L_1$ rotatably attached with one end to a shaft $O_1$. The area of rotation $\alpha$ is within range $0 \leqq \alpha \leqq \pi$ radians. A flexible but inelastic band 12, hereafter named first band, is attached to the free end A of the arm. It is to be understood that the wording "flexible but inelastic" is meant to define a band or wire that is substantially free of elasticity in the longitudinal direction of the band but can be bent in the transversal direction. The band runs downwards over a pulley wheel $P_1$, which pulley wheel is arranged on a horizontal plane 14 in FIG. 1, which plane intersects the axis of rotation of the arm 10 and with the same distance between the pulley wheel and the axis of rotation as the length of the arm $L_1=A\ O_1=P_1O_1$. The first band is attached to an elastic element $Ee_1$ (by elastic element it can be assumed any elastic means such as springs, rubber bands, gas filled pistons and the like).

For $\alpha=0$ the force $Fe_1=0$.

By turning the arm 10 clockwise for an arbitrary angle $\alpha$ (in its rotation range) the elastic element $Ee_1$ is prolonged for a certain length $A\ P_1=X_1$. The consequence of the prolongation of the elastic element $Ee_1$ is the appearance of an elastic force $Fe_1$ according the Hooks law i.e.:

$$Fe_1=K_1 \cdot X_1 \tag{1}$$

where $K_1$ is the elasticity coefficient for the elastic element.

For the arm angle $\alpha=\pi$ radians, the length of the prolongation of the elastic $Ee_1$ element is $A\ P_1=X_1=2 \cdot L_1$ which is assumed to be the initial prolongation of the element.

The force $Fe_1$ creates a counter clockwise torque $$M_{11}=Fe_1 \cdot h_1=K_1 \cdot X_1 \cdot h_1 \tag{2}$$

around shaft $O_1$.

A second flexible, but also inelastic, band 16 is fixated to the arm 10 at a point B between the rotation shaft $O_1$ and the attachment point A for the first band. The attachment point B of the arm lies on $L_2$ distance from the axis of rotation $O_1$.

The second band is led via a second pulley wheel $P_2$, which also is placed on the above mentioned horizontal plane 14, with the distance $L_2$ from the rotation shaft $O_1$ of the arm 10 (i.e. $BO_1=P_2O_1$), to a wheel 18, hereafter named first wheel, where the second band is attached to the periphery of the wheel at a point D. The first wheel is rotatably arranged to a shaft $O_2$ and has a radius R. In order to get the proper function of the device, the described elements must be geometrically arranged so that in any position of both bands, they must always be in touch (by being tangent to or by braking over) with the corresponding pulley wheels ($P_1$ and $P_2$).

The length $X_2=P_2D$ i.e. the portion of the second band wound on the first wheel, is the prolongation, due to the clockwise rotation of the first wheel. This prolongation $X_2$ is defined by For $\alpha=0$, $X_2=P_2D=0$.

For $\alpha=\pi$, $X_2=P_2D=2\cdot L_2$

The clockwise rotation of the first wheel produces a certain force $F_2$ in the second band, which creates a torque around the shaft $O_1$:

$$M_{12}=F_2\cdot h_2 \tag{3}$$

counter in the direction (in a steady state equal in the intensity) to the torque $M_{11}$.

From the geometrical arrangement of the involved components it can be derived the expression of the force $F_2$ as a function of the prolongation $X_2$ and the given parameters.

When the arm 10 is not in motion, then the torques $M_{11}$ and $M_{12}$ are in the equilibrium i.e.

$$M_{11}=K_1\cdot X_1\cdot h_1=M_{12}=F_2\cdot h_2$$

or $$F_2=K_1\cdot X_1\cdot h_1/h_2 \tag{4}$$

From the geometry of the components and the action of the forces, the following equations may be developed:

Obviously:

$$\alpha+2\cdot\beta=\pi,\ \alpha+\phi=\pi \text{ i.e.}$$

$$\beta=\phi/2 \tag{5}$$

Further:

$$h_1=L_1\cdot\sin\beta \tag{6}$$

$$h_2=L_2\cdot\cos\beta \tag{7}$$

$$(X_1/2)=L_1\cdot\cos\beta$$

i.e.

$$X_1=2\cdot L_1\cdot\cos\beta \tag{8}$$

$$\sin\beta=BP_2/2\cdot L_2 \tag{9}$$

From 4, 6, 7 and 8 comes:

$$F_2=K_1\cdot X_1\cdot h_1/h_2=2\cdot K_1\cdot L_1\cdot\sin\beta\cdot L_1\cdot\cos\beta/L_2\cdot\cos\beta$$

$$F_2=K_1\cdot(L_1/L_2)^2\cdot BP_2 \tag{10}$$

From $$BP_2=2\cdot L_2-X_2$$

and 10 $F_2$ can be expressed as a function of the prolongation $X_2$ $$F_2=K_1\cdot(L_1/L_2)^2\cdot BP_2=K_1\cdot(L_1/L_2)^2\cdot(2\cdot L_2-X_2)$$

or $$F_2=2\cdot K_1\cdot L_1^2/L_2-K_1\cdot(L_1/L_2)^2\cdot X_2 \tag{11}$$

Which proves that the described device produces the linear forces conversion, ie. from an uprising force $F_1$ as a linear function of the displacement $X_1$, to linear down falling force $F_2$ as a function of by it caused displacement $X_2$. QED.

A second wheel 20 is firmly attached to the first wheel and also rotatably arranged to the shaft $O_2$. The second wheel 20 has a radius r, that in the embodiment shown is smaller than the radius R of the first wheel.

Because both wheels are firmly attached to each other they rotate together simultaneously. Therefore when considering their rotation they will be referred to as the wheels pair.

A third flexible but inelastic band 22 is with one end attached to the periphery of the second wheel at a point E. The other end of the third band is attached to the right side of a second elastic element $Ee_3$.

The geometrical arrangement between the first wheel and band 16 and the second wheel and the band 22 is such that the bands are always is in tangent with the respective wheel at the point where each band first touches its wheel surface.

According to the Hooks law the elastic force $Fe_3$ if the second elastic element $Ee_3$ is:

$$Fe_3=K_3\cdot(X_3+X_3(0))$$

where $X_3$ is the prolongation of the elastic element due to the rotation of the second wheel counter clockwise, while $X_3(0)$ is the resilience of $Fe_3$ during initial position (i.e. for $\gamma=0$, i.e. $X_3=0$), due to the pre-setting the pre-tension force $K_3\cdot X_3(0)$.

Assume that one end of a non-elastic flexible band (23) is attached on the left side of the elastic element $Ee_3$, while the other end of this band is connected to a pulling element (for ex. winch) which by expanding the elastic element $Ee_3$ for the length $X_3(0)$ creates the pre-tension force $K_3\cdot X_3(0)$.

The force $Fe_3$ creates a clockwise torque around the shaft $O_2$, $$M_3=Fe3\cdot r=K_3\cdot(X_3+X_3(0))\cdot r$$

Torques $M_2$ and $M_3$ are acting counter to each other. Due that $F_2(\pi)=0$ even the small torque of the pre-tension force $K_3\cdot X_3(0)\cdot r=M_3(0)$ keeps the arm 10 and wheel pair in the initial state ($\alpha=\pi$, $\gamma=0$, $X_2=2\cdot L_2$)

Assume that in the initial position a certain external counter clockwise torque $M_{ext}$ (high enough to overcome the torque of the pre-tension force $K_3\cdot X_3(0)\cdot r$) is applied to the wheels pair and forces them to rotate counter clockwise. Consequently the band 22 is pulled while the band 16 is released.

The counter clockwise torque $M_1$ of the force $Fe_1$, turned the arm 10 counter clockwise to the equilibrium position, getting some angle $\alpha$ with the plane 14. The wheels pair will be able to rotate counter clockwise until, with a certain angle $\gamma$ radian equilibrium of the involved torques is established. Suppose that FIG. 1 illustrates this equilibrium state.

In this case the following equations can be established:

The band 22 pulled out the elastic element Ee3 which will be prolonged for certain arc length $$TE=X_3=\gamma\cdot r.$$

Thus generating the linearly increased torque $$M_3=K_3\cdot(X_3+X_3(0))\cdot r=K_3\cdot(\gamma\cdot r+X_3(0))\cdot r. \tag{14}$$

The second band 16 is rewound from the first wheel 18 for a length $BP_2$ $$R\cdot\gamma=2\cdot L_2-X_2=BP_2$$

including it in 10 comes:

$$F_2=K_1\cdot(L_1/L_2)^2\cdot BP_2=K_1\cdot(L_1/L_2)^2\cdot R\cdot\gamma \tag{15}$$

Assume that the corresponding torque around the shaft O2 is:

The clockwise rotation of the first wheel for a certain angle $\gamma$, creates the force $F_2$ which in its turn creates a torque $$M_2=F_2\cdot R.=K_1\cdot(L_1/L_2)^2\cdot\gamma\cdot R^2 \tag{16}$$

around the shaft $O_2$

The clockwise torque $M_2=R\cdot F_2$, together with the torque Mext keeps a balance with the torque $M_3=Fe3\cdot r=K_3\cdot(X_3+X_3(0))\cdot r$.

In the equilibrium state the following equations can be established:

$$M_{ext} = M_3 - M_2 \tag{17}$$

$$= K_3\cdot(\gamma\cdot r + X_3(0))\cdot r - K_1\cdot\left(\frac{L_1}{L_2}\right)^2\cdot\gamma\cdot R^2$$

$$= K_3\cdot\gamma\cdot r^2 + K_3\cdot X_3(0)\cdot r - K_1\cdot\left(\frac{L_1}{L_2}\right)^2\cdot\gamma\cdot R^2$$

$$= K_3\cdot X_3(0)\cdot r + \left(K_3\cdot r^2 - K_1\left(\frac{L_1}{L_2}\right)^2\cdot R^2\right)\cdot\gamma$$

The condition to obtain the resulting torque $M_{ext}$ constant ie. independent of the angle γ is that the expression in front of this variable is zero. This means that:

$$r^2\cdot K_3 - R^2\cdot K_1\cdot(L_1/L_2)^2=0$$

$$r^2\cdot K_3=R^2\cdot K_1\cdot(L_1/L_2)^2$$

i.e.

$$K_3/K_1=(R^2/r^2)\cdot(L_1/L_2)^2 \tag{18}$$

Under assumption that a designed device satisfies the requirement 18 the resulting torque (and from it derived force) is:

$$M_{ext}=r\cdot K_3\cdot X_3(0) \tag{19}$$

ie.: defined only by the pre-tension force $K_3\cdot X_3(0)$ and consequently independent of the movement angle γ

The resulting torque $M_{ext}$ can be pre-set to an arbitrary value in the range from zero to $r\cdot K_3\cdot X_3(0)$max.

Where $X_3(0)$max is by a design defined maximal pre-extension of the elastic element Ee3.

Figure 2:
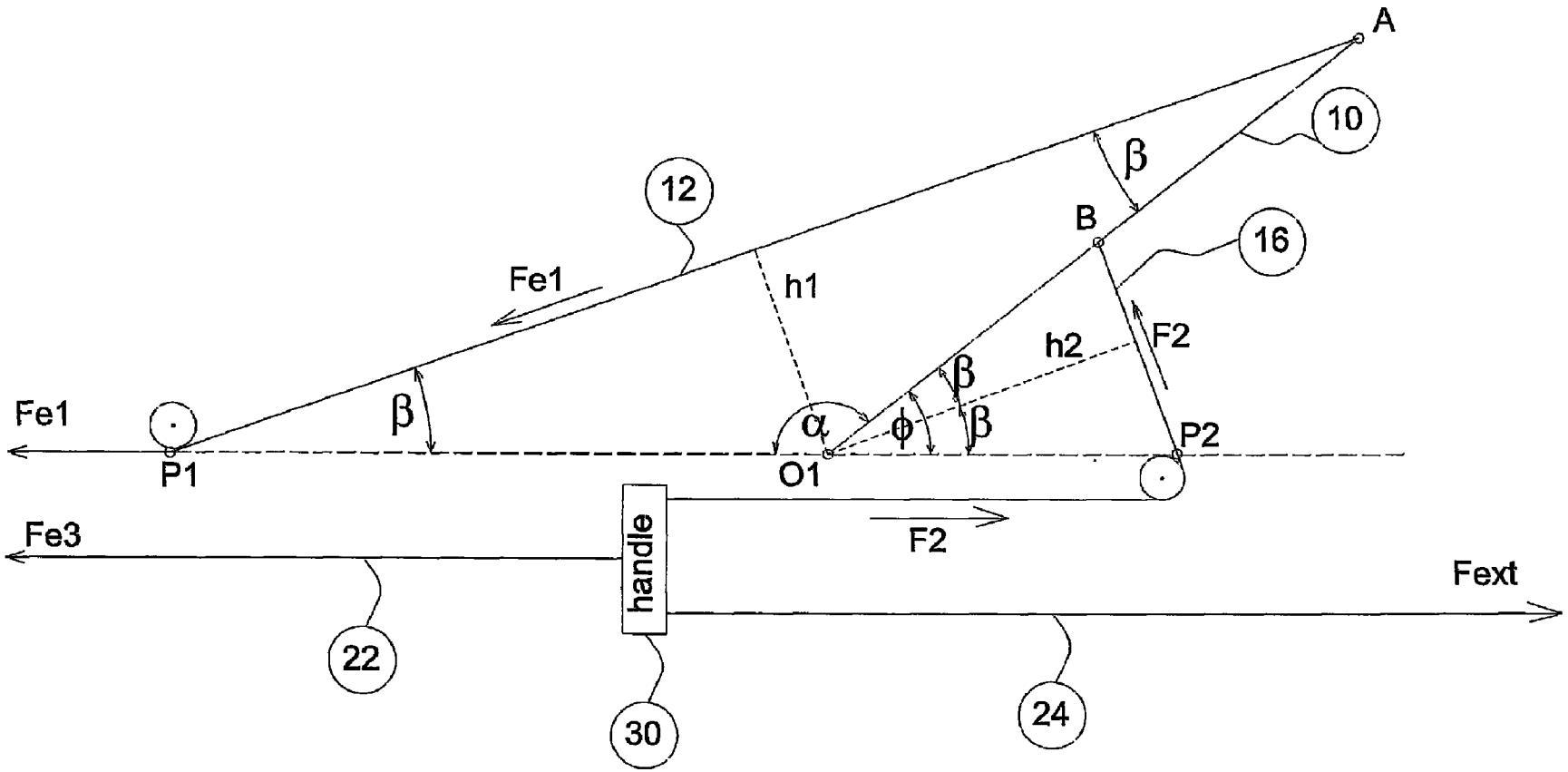

FIG. 2 shows the solution using translatory movements for obtaining the constant result force. Instead of a rotating wheel, it is assumed a handle 30 or the like means which may be employed in order to obtain a constant resulting force Fext by pulling non-elastic band 24.

$$Fext=Fe_3-F_2=K_3\cdot(X_3+X_3(0))-K_1\cdot(L_1/L_2)^2\cdot BP_2 \tag{20}$$

All bands Band 16, Band 22 and Band 24 are pulled simultaneously. Therefore they always pass the same distance X at a time. This implies that:

$$BP_2 = X_3 = X_{ext} = X \tag{21}$$

$$Fext = K_3\cdot(X + X(0)) - K_1\cdot\left(\frac{L_1}{L_2}\right)^2\cdot X \tag{22}$$

$$= K_3\cdot X + K_3\cdot X(0) - K_1\cdot\left(\frac{L_1}{L_2}\right)^2\cdot X$$

$$= K_3\cdot X(0)) + \left(K_3 - K_1\cdot\left(\frac{L_1}{L_2}\right)^2\right)\cdot X$$

The condition for obtaining the constant value of Fext is that the coefficient in the front of the variable X is zero i.e.:

$$K_3-K_1\cdot(L_1/L_2)^2=0$$

Or $$K_3/K_1=(L_1/L_2)^2 \tag{23}$$

Then the constant value of Fs is:

$$Fext=K_3\cdot X(0) \tag{24}$$

Where $$0\leqq Fext\leqq K_3\cdot X(0)\max$$

The Integration of the Previous and the Present Innovation

In order to get considerably broader range of force pre-setting values, obviously it is desirable that the previous and the actual inventions are joined together and implemented in a single device. As a matter of fact, it can be accomplished with the slightly modification and practically with the same components as are needed for one of innovations.

The joined device operates in two modes: addition mode according to the previous invention and subtraction mode according the actual invention. In the proceeding text, the principle is explained on a successfully realised implementation (FIG. 3 and FIG. 4) where the operation mode alternation is obtained by a very simple manipulation.

Figure 3:
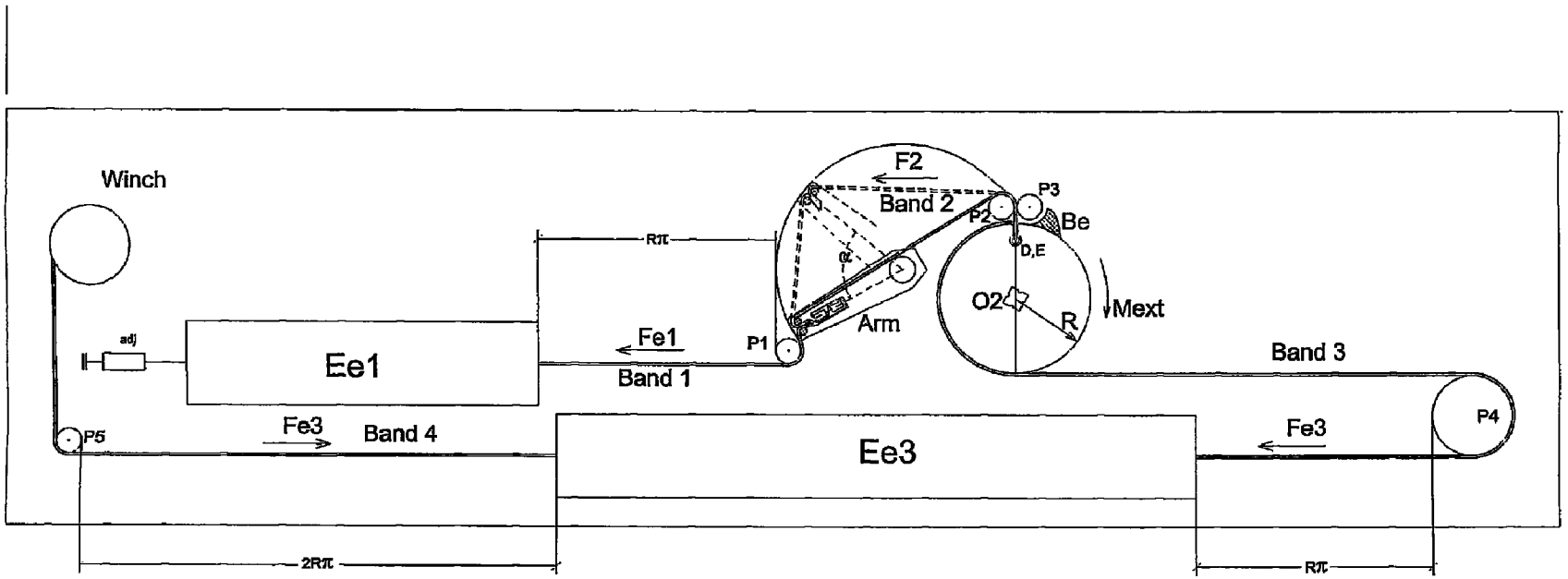
Figure 4:
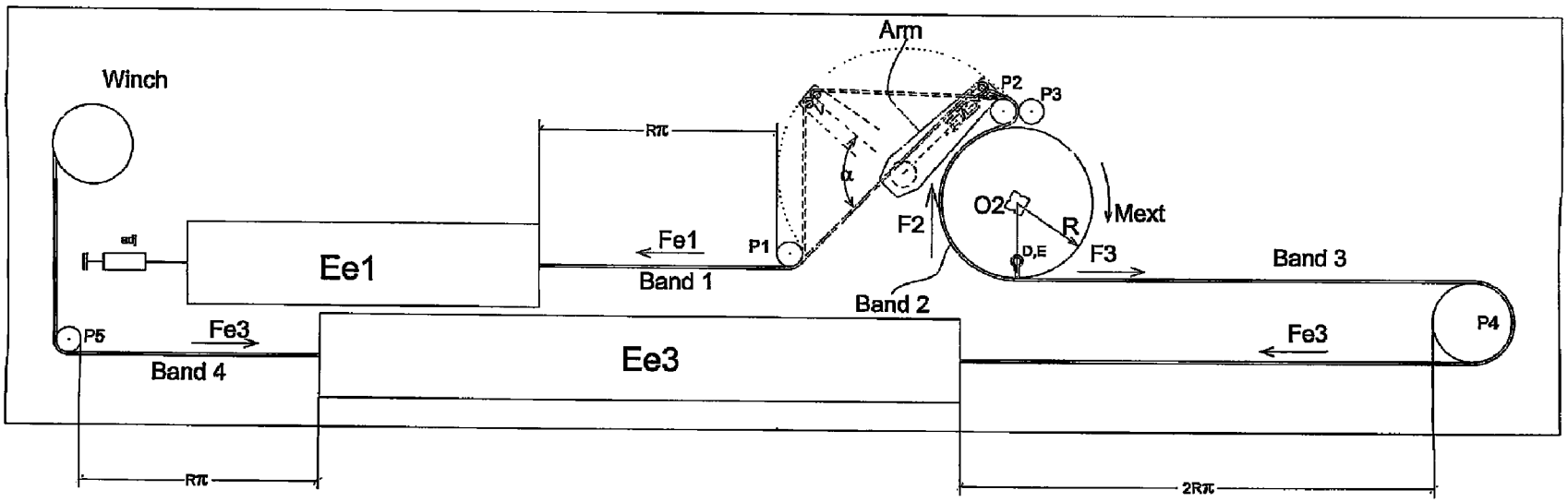

FIG. 3 illustrates the initial state of the device in the addition mode of operation, while FIG. 4 illustrates the initial state in the subtraction mode of operation. The conditions (equation 18) for the constant resulting torque is valid for both inventions. They are satisfied by choosing:

$$R=r,\ K_3=K_1=K \text{ and } L_1=L_2=L$$

In order that both wheels can be realised by a single one and that all components can be placed in one plane, the arm length is chosen to be $$L=R\cdot\pi/2$$

The only new functional element is a pulley P3. It enables to increase the accuracy in the beginning of the movement in the force addition mode. In both modes the external torque Mext is applied clockwise in the area of rotation angle γ is within the ranges $0\leqq\gamma\leqq\pi$ and $\pi\leqq\gamma\leqq 2\cdot\pi$.

The points D and E where Band 2 and Band 3 respective, are connected with the wheel are joined together.

The differences between initial states of both operation modes are:

In the addition mode points D and E are placed directly under the pulley pair P2 and P3 while in the subtraction mode they are above point T on the wheel, where Band 3 tangents it.

In the addition mode the maximal prolongation length on the band 3 side is $R\cdot\pi$ while max prolongation length on the Band 4 side is $2\cdot R\cdot\pi$.

The elastic element $Ee_1$ can be expanded by pulling Band 1 maximally for the length $R\cdot\pi$.

In the addition mode a blocking element Be is activated in order to preclude that the pre-setting force will wind the wheel back.

In the subtractions mode such rewinding is precluded through the arm blocking by the pulley P2.

In the addition mode during rotation clockwise by Mext, the Band 2 is winded over band 3. (It is assumed that bands are enough thin that the increase of radius of F2 torque is negligible.)

The alternation from the addition mode to the subtraction mode is obtained by:

1. deactivating the blocking element Be and 2. pulling (ex by winch) band 4 until the arm is rotated counter clockwise until the $\alpha=\pi$.

The alternation from the subtractions mode to the additions mode is obtained by:

1. releasing the band 4 until arm is rotated clockwise to the $\alpha=0$.

2. reactivating the blocking element Be.

In the implementation explained by FIG. 3 and FIG. 4

$$X_3(0)\max=R\cdot\pi$$

causing that the output torque has the range of values that follows:

In the subtraction mode: $0\leqq Mext\leqq K\cdot R^2\cdot\pi$.

In the addition mode $K\cdot R^2\leqq Mext\leqq 2\cdot K\cdot R^2\cdot\pi$

What doubled the range of variation of the total output torque Mexttot. ie:

$$0\leqq Mexttot\leqq 2\cdot\pi K\cdot R^2$$

The embodiments of the invention as described above and shown in the drawings are to be regarded as non-limiting examples and that the invention is defined by the scope of the claims.

One other area of use where constant force is desirable is medicine:

for example the dosage of liquids, such as syringes, where the plunger is to be pressed into the barrel of the syringe with a constant speed/force.

Or

Pulling a traumatised limb after an orthopedic treatment, with the given force, which is independent of, displacement or jerk of the limb.

The invention claimed is:

1. A device for obtaining a predetermined linear force, comprising:

a first elastic force means;

a first force output means comprising a non-elastic, flexible elongated member;

a force transformation means arranged between said first elastic force means and the first force output means, pulling the first force output means creates a tension in said first elastic force means, wherein the force transformation means is structured and arranged so that a first pulling force required on the first force output means decreases with a pulling distance that the first force output means is pulled, a second elastic force means;

a second force output means attached to said second elastic force means, wherein a second pulling force required on the second force output means increases with the pulling distance the second force output means is pulled, the first and second force output means are connected to each other to sum the first and second pulling forces as a resultant pulling force, characteristics of the first and second elastic force means are chosen so that the resultant pulling force is substantially constant during the pulling distance, and means for adjusting the resultant pulling force from substantially zero and upwards.

2. The device according to claim 1, wherein said force transformation means includes an arm pivotally arranged to a shaft, said first elastic force means is attached to said arm, said first force output means is attached to said arm with one end, a first direction changing means is arranged in contact with said first force output means between a said attached end and a pulling end, wherein the distance between the pivoting point and the attachment point of said first force output means and said arm is substantially equal to the distance between the pivoting point and said first direction changing means.

3. The device according to claim 2, wherein a second non-elastic, flexible elongated member is arranged between said first elastic means and said arm, that a second direction changing means is arranged in contact with said second member between the attachment point to the first elastic means and the attachment point to said arm, wherein the distance between the pivoting point and the attachment point of said second member to said arm is substantially equal to the distance between the pivoting point and said second direction changing means.

4. The device according to claim 3, wherein said first and second direction changing means are pulley wheels.

5. The device according to claim 1, wherein a pulling end of said first force output means is attached to a rotation means rotatable around a shaft at a distance in order to obtain a torque decreasing with turning angle.

6. The device according to claim 2, wherein the pulling end of said first force output means is attached to a rotation means rotatable around a shaft at a distance in order to obtain a torque decreasing with turning angle.

7. The device according to claim 3, wherein the pulling end of said first force output means is attached to a rotation means rotatable around a shaft at a distance in order to obtain a torque decreasing with turning angle.

* * * * *